US005744013A

United States Patent [19]

Botts et al.

[11] Patent Number: 5,744,013

[45] Date of Patent: Apr. 28, 1998

[54] ANODE BASKET FOR CONTROLLING PLATING THICKNESS DISTRIBUTION

[75] Inventors: Robert R Botts; Swati V. Joshi; Louis W. Nicholls, all of Durham, N.C.

[73] Assignee: Mitsubishi Semiconductor America, Inc., Durham, N.C.

[21] Appl. No.: 764,807

[22] Filed: Dec. 12, 1996

[51] Int. Cl.[6] ..... C25D 17/02

[52] U.S. Cl. ..... 204/242; 204/285; 204/287; 204/290 F

[58] Field of Search ..... 204/285, 287, 204/297 W, 290 F; 205/272

[56] References Cited

U.S. PATENT DOCUMENTS

| | | | |
|---|---|---|---|
| 578,171 | 3/1897 | Turner | 204/285 X |
| 3,223,611 | 12/1965 | Wells et al. | 204/297 R |
| 3,300,396 | 1/1967 | Walker | 205/272 |
| 3,926,772 | 12/1975 | Cordone et al. . | |
| 4,039,403 | 8/1977 | Astley et al. | 204/287 X |
| 4,059,493 | 11/1977 | Rice . | |
| 4,401,522 | 8/1983 | Buschow et al. . | |
| 4,447,298 | 5/1984 | Betschler . | |
| 4,569,744 | 2/1986 | Walker | 204/287 X |
| 4,610,773 | 9/1986 | Takayasu | 204/287 X |
| 4,832,812 | 5/1989 | Brown . | |
| 4,904,351 | 2/1990 | Morin . | |
| 5,098,544 | 3/1992 | Brannan et al. . | |
| 5,340,456 | 8/1994 | Mehler . | |

*Primary Examiner*—Donald R. Valentine

*Attorney, Agent, or Firm*—Lowe, Price, LeBlanc & Becker

[57] ABSTRACT

An anode basket containing anode particles used for electroplating a work piece. The anode basket includes baffles positioned inside the basket at selected locations. Hinges secure the baffles to opposing sidewalls of the basket and allow the baffles to pivot when sufficient manual force is applied to the respective hinges and/or baffle. The hinged baffles can be positioned to form separate compartments, enabling anode particles to be placed in different amounts at selected locations. If desired, some of the locations can have no anode particles. This permits more focused control of the metal ions.

8 Claims, 2 Drawing Sheets

ANODE BASKET FOR CONTROLLING PLATING THICKNESS DISTRIBUTION

FIELD OF THE INVENTION

The invention relates generally to electroplating and more particularly, to an anode basket used in electroplating.

BACKGROUND OF THE INVENTION

During manufacture of semiconductor chips for mounting on printed circuit boards carrying the chips and other circuit components, the conductors of the chips are electroplated with a solder material comprising tin and lead to improve solderability of the chip to the board. The step of electroplating is typically performed while several semiconductor chips are mounted on a lead frame suspended by hooks on a cathode rack placed in an electroplating bath. The bath contains an anode which conducts an electrical current which passes to the cathode rack and lead frames to deposit metal on the lead frames, especially on the outer leads of the semiconductor chips via metal ions directed from the anode to the cathode. After electroplating, the lead frames are severed and the individual semiconductor chips are separated.

The thickness of the deposited metal is a function of the current density which in turn is a function of the current distribution that is primarily influenced by the geometry of the plating bath. The positive electrode in the plating bath, the anode, conducts the current into the plating solution and produces an electric field between the anode and the cathode (work piece). The electric field influences the current distribution, and thus the thickness of the deposited metal, over the work piece surface. Because the field strength of the electric field is greater on the edges than the center of the work piece, the electroplating thickness tends to be greater at the edges. To make plating thickness more uniform, it is necessary to produce an electric field that is uniform across the surface of the work piece to prevent extraneous current flow toward the work piece periphery.

A conventional electric field distribution that may be produced in an electroplating bath is schematically depicted in FIG. 1. The electric field 2 emanates from anode 3 toward cathode rack 4 supporting a work piece 5. As a result of non-uniform field distribution, current is attracted to edges 6, 7 of work piece 5. As a result, plating thickness tends to be greater at edges 6, 7 than at the middle 8 of the work piece.

Various attempts have been made to improve distribution of plating materials on a work piece. For example, U.S. Pat. Nos. 3,954,569 and 4,077,864 to Vanderveer et al. disclose an electroplating method and apparatus including an anode basket housing nickel chips and covered by non-conductive shields. The shields include a cut-out to expose a predetermined area of the anode to the work piece cathode. By reducing the exposed anode area, a higher tank voltage can be utilized. A disclosed advantage of the anode shields of Vanderveer et al. is to improve ductility of the electroplated surface by increasing the anode current density while maintaining the higher voltage level. However, the shield does not control the electric field for unifying the plating thickness over the entire surface of the work piece.

Another example of an anode shielding apparatus is disclosed in U.S. Pat. No. 3,862,891 to Smith, in which parallel non-conductive surfaces are positioned upwardly from and along two sides of the anode surface. The non-conductive surfaces are intended to maintain a uniform plating current distribution without interfering with the free flow of electrolyte solution through the electroplating tank. However, the disclosed apparatus does not permit adjustment of the electrical field emanating from the anode to control plating thickness.

Some anodic electroplating processes utilize an anode basket holding anode pieces. An example of one anode basket is shown in FIG. 2. The anode basket 10 is generally rectangular in shape, and formed of an open mesh, non-corrosive metal such as titanium or equivalent metal which possess good salt corrosion properties. The anode basket 10 is filled with anode particles (not shown) of tin-lead alloy via open top 36. These particles may be shaped as chips, balls or any other suitable shape. Additionally, the anode particles may be of any other electroplating materials, such as gold, palladium, chrome, tin or tin-palladium alloy. The top of basket 10 bears hooks 14 permitting the basket to be suspended from a frame or the side of a tank (not shown) and immersed in an electroplating bath. FIG. 1 shows a work piece 5 and a singe anode basket. However, typically, two anode baskets 10 are used in the electroplating process with the work piece 5 suspended between the two anode baskets. This permits the plating to be deposited on both sides of the work piece.

As a way of controlling the plating thickness over the entire surface of a work piece using such an anode basket 10, the inventors have proposed an anode mask conforming to the shape of the anode basket so that the basket may be placed within anode mask; U.S patent application Ser. No. 08/732,655 filed Oct. 16, 1996. A plurality of plates are secured to the anode mask and block portions of the current emanating from basket. The resulting electric field emanating from anode basket toward the cathode rack advantageously encounters the work piece uniformly, thus achieving a uniform thickness of the deposited plating on the work piece. However, this anode mask does not provide the high degree of focused control of the metal ions as is required in some anodic electroplating processes.

SUMMARY OF THE INVENTION

It is feature and advantage of the invention to provide an anode basket which enables focused control of the metal ions.

It is another feature and advantage of the invention to provide a novel anode basket which permits the metal ions to be directed in a greater amount to where the plating deposit is typically thinner and less to where the deposit is thicker.

Still other features and advantages of the present invention will become readily apparent to those skilled in this art from the following detailed description, where only the preferred embodiment of the invention is shown and described, simply by way of illustration of the best mode contemplated of carrying out the invention. As will be realized, the invention is capable of other and different embodiments in various obvious respects, all without departing from the invention. Accordingly, the drawings and description are to be regarded as illustrative in nature, and not as restrictive.

DETAILED DESCRIPTION OF THE DRAWINGS

Figure 2:
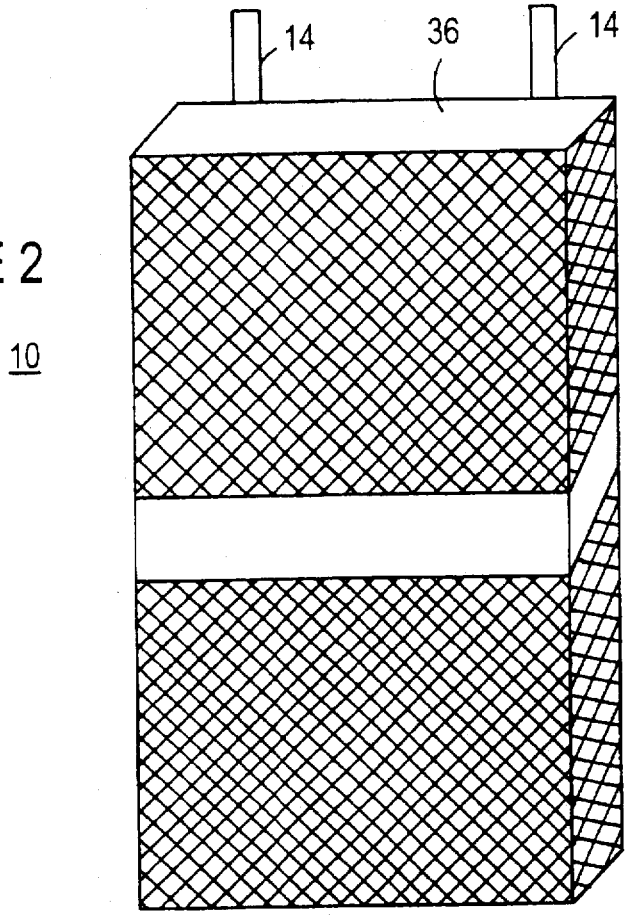
FIG. 2 is a perspective view of a typical anode basket.
Figure 1:
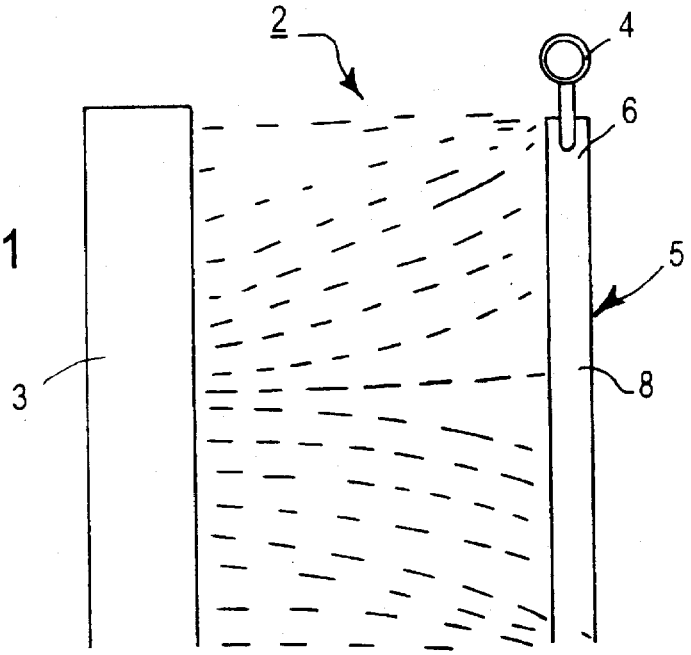
FIG. 1 is a schematic illustration of the electric field generated by an anode in an electroplating apparatus.
Figure 3:
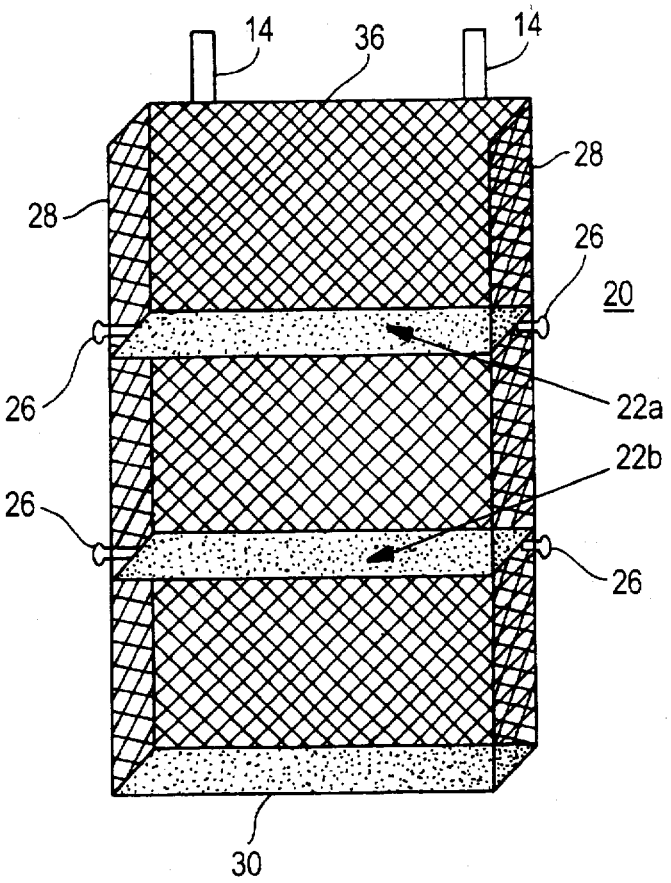
FIG. 3 is a perspective view of an anode basket according to the present invention.
Figure 4:
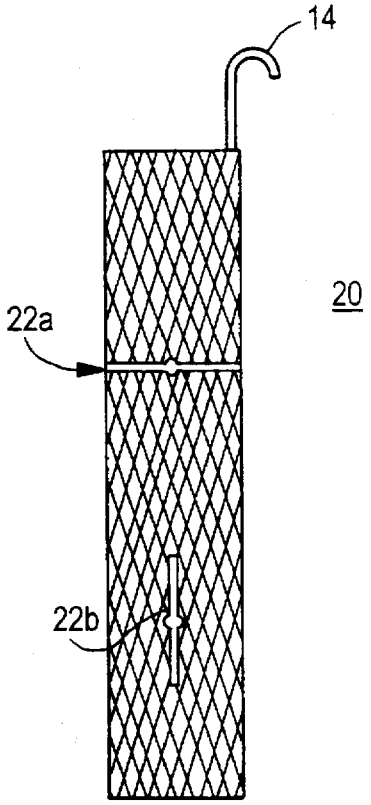
FIG. 4 is a side view of the anode basket of FIG. 3.

Referring to FIGS. 3 and 4, anode basket 20 is a rectangular box-like structure having side walls 28 and end wall 30 formed of an open mesh, non-corrosive conductive metal such as titanium. Hooks 14 permit the basket to be suspended from a frame or the side of a tank (not shown) and immersed in an electroplating bath. In the interior of the anode basket 20 are baffles 22*a* and 22*b*, positioned at selected locations. The baffles 22*a* and 22*b* are formed of the same open mesh, non-corrosive conductive metal as the basket 20, and are positioned at different locations in the basket. Hinges 26, formed of the same non-corrosive conductive metal as the basket 20 and the baffles 22*a*, 22*b*, secure the baffles 22*a*, 22*b* to opposing sidewalls 28 of the basket and allow the baffles 22*a*, 22*b* to pivot when sufficient manual force is applied to the respective hinges and/or baffle. With the hinges 26, each baffle 22*a* and 22*b* can be pivoted to a horizontal position as depicted in FIG. 4 for baffle 22*a*, or a vertical position as depicted in FIG. 4 for baffle 22*b*. Separate compartments are formed by positioning a baffle horizontally. The hinges 26 are designed to hold the baffles in the horizontal position until sufficient manual force is applied to the hinges and/or baffle even when anode material is placed on it. If necessary, small hooks (not shown) made of the same non-corrosive conductive metal as the basket 20, or other similar type latching mechanism, can be used to secure the baffles in the horizontal position.

The separate compartments formed by horizontally positioned baffles enable the anode particles to be placed in the same or different amounts at selected locations via loading through the open top 36. Thus, the baffles 22*a* and 22*b* will allow certain areas of the anode basket to have a first amount of anode particles, other areas to have a second smaller amount of anode particles, and still other areas to have no anode particles. This will enable more focused control of the metal ions. In other words, the baffles enable the metal ions to be directed in a greater amount to where the plating deposit on the work piece is typically thinner and in a lesser amount to where the deposit on the work piece is thicker. Also, as the baffles have an open mesh configuration, smaller anode particles (sludge) will flow to the bottom of the anode basket, reducing contamination and allowing more room for full sized anode balls.

When positioning anode particles in the different compartments formed by the baffles 22*a*, 22*b*, the compartments are loaded sequentially starting from the compartment closest to the end wall 30 and then proceeding in an upward direction to the adjacent compartment. The compartment closest to the end wall 30 is loaded by positioning all the baffles in the vertical position and loading the desired amount of anode particles through the open top 36. Then the compartment adjacent this compartment is loaded with the desired amount of anode particles by positioning the baffle adjoining the two compartments (22*b* for example) in the horizontal position and loading the adjacent compartment with the desired amount of anode particles. Once this adjacent compartment has been loaded, or in the case the adjacent compartment is not to have any anode particles, the next adjacent compartment is loaded by positioning the next adjacent baffle (22*a* for example) in the horizontal position. Any remaining compartments would be loaded in a similar manner.

While two baffles 22*a* and 22*b* are shown in FIGS. 3 and 4, it will be appreciated by one skilled in the art that a greater number of baffles can be provided if necessary. While the baffles are shown hinged in the middle of sidewalls 28, it will be appreciated also by one skilled in the art that the baffles can be hinged at different locations and achieve the same effects.

There accordingly has been described an anode basket which enables focused control of the metal ions. More specifically, the novel anode basket permits the metal ions to be directed in a greater amount to where the plating deposit is typically thinner and less to where the deposit is thicker.

The many features and advantages of the invention are apparent from the detailed specification, and thus, it is intended by the appended claims to cover all such features and advantages of the invention which fall within the true spirit and scope of the invention. Since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for electroplating a work piece with an electroplate metal, the apparatus comprising:

a cathode rack configured to support the work piece; and an anode basket in which anode particles are contained, the anode basket including a plurality of baffles positioned in the basket at selected locations, the plurality of baffles providing separate compartments in the basket for the anode particles, wherein each baffle is secured to the anode basket via hinges, allowing the baffle to pivot about the hinge.

2. The apparatus of claim 1, wherein the anode basket is rectangular in shape.

3. The apparatus of claim 3, wherein the anode basket and the plurality of baffles are formed of an open mesh, non-corrosive conductive metal.

4. The apparatus of claim 3, wherein the non-corrosive conductive metal is titanium.

5. An apparatus for electroplating a work piece with an electroplate metal, the apparatus comprising:

a cathode rack configured to support the work piece; and an anode basket in which anode particles are contained, the anode basket including a plurality of baffles positioned in the basket at selected locations, the plurality of baffles providing separate compartments in the basket for the anode particles, wherein each baffle is secured to the anode basket via hinges, and the anode basket and the plurality of baffles are formed of titanium in an open mesh.

6. An anode basket for holding anode particles comprising:

a rectangular box-like structure having walls formed of an open mesh, non-corrosive conductive metal; and a plurality of baffles positioned in the interior of the rectangular box-like structure at selected locations, the plurality of baffles providing separate compartments for the anode particles, wherein each baffle is secured to two opposing walls of the rectangular box-like structure via hinges, allowing the baffle to pivot about the hinge.

7. The anode basket of claim 6, wherein the plurality of baffles are formed of an open mesh, non-corrosive conductive metal.

8. The anode of claim 7, wherein the non-corrosive conductive metal is titanium.

* * * * *